US005848739A

United States Patent [19]

Wilkinson

[11] Patent Number: 5,848,739

[45] Date of Patent: Dec. 15, 1998

[54] PUMP DISPENSER FOR FLOWABLE MATERIALS

[75] Inventor: William T. Wilkinson, Fort Lauderdale, Fla.

[73] Assignee: Package Research, Inc., Cleveland, Ohio

[21] Appl. No.: 783,956

[22] Filed: Jan. 17, 1997

[51] Int. Cl.[6] ..... B67D 5/42

[52] U.S. Cl. ..... 222/386; 222/137; 222/319; 222/542

[58] Field of Search ..... 222/542, 386, 222/319, 137; 141/27

[56] References Cited

U.S. PATENT DOCUMENTS

| | | | |
|---|---|---|---|
| 1,699,873 | 1/1929 | Brodsky | 222/386 |
| 1,714,482 | 5/1929 | Schmuziger | 222/386 |

*Primary Examiner*—David J. Walczak
*Assistant Examiner*—Timothy L. Maust
*Attorney, Agent, or Firm*—Connolly & Hutz

[57] ABSTRACT

A pump type fluid dispenser comprises an outer barrel closed at its lower end with a plunger slidably mounted in the upper end of the barrel. A dispensing spout for the fluid within the combined chamber of the barrel and plunger is located at the upper end of the plunger. A leakage collection chamber is disposed around the plunger between the piston head of the plunger and the top of the barrel.

5 Claims, 1 Drawing Sheet

PUMP DISPENSER FOR FLOWABLE MATERIALS

BACKGROUND OF THE INVENTION

Various dispensers are known for dispensing flowable materials, such as toothpaste, lotions, creams and detergents. One popular form of dispenser is a pump type which includes a rigid barrel in which the fluid is housed with a plunger mounted inside the barrel through the lower end of the barrel. As the barrel is moved downwardly, or the plunger inwardly, the effective size of the chamber within the barrel is decreased which forces the fluid to be expelled through a dispensing opening in the barrel. One of the problems with conventional pump type dispensers is seepage which requires a very effective sealing system.

SUMMARY OF THE INVENTION

An object of this invention is to provide a pump dispenser for flowable materials which overcomes the seepage problems.

A further object of this invention is to provide such a dispenser which need not have a perfect seal to operate efficiently.

In accordance with this invention the plunger is inserted through the upper end rather than the lower end of the barrel and the dispensing opening is at the top of the plunger. The plunger includes a peripheral piston head which makes sealing contact with the inner surface of the barrel so that upon a sliding of the plunger deeper into the barrel the combined chamber for holding the fluid is decreased and the fluid flows through the dispensing spout at the top of the plunger.

Preferably a collection chamber is disposed between the piston head and the top of the barrel around the outer surface of the plunger to collect any fluid escaping past the seal.

THE DRAWINGS

DETAILED DESCRIPTION

Figure 1:
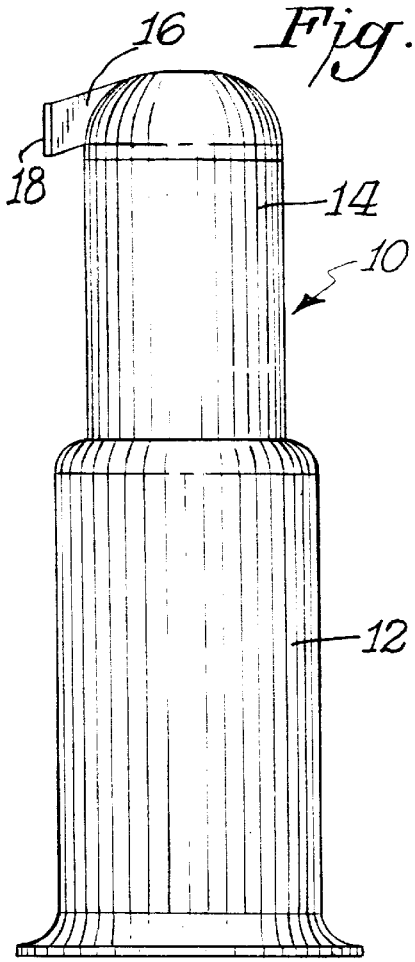
FIG. 1 is a side elevational view of a pump dispenser in accordance with this invention.

FIG. 1 illustrates a basic dispenser 10 in accordance with this invention. As shown therein a rigid barrel 12 is provided into which is slidably mounted a plunger 14. The plunger has a dispensing spout 16 with a removable seal 18 optionally covering the spout. The general arrangement of the components is the reverse of known type plungers such as shown in U.S. Pat. Nos. 4,742,940 and 5,092,496, all of the details of which are incorporated herein by reference thereto particularly with regard to the general manner of operation of a pump type plunger.

Figure 2:
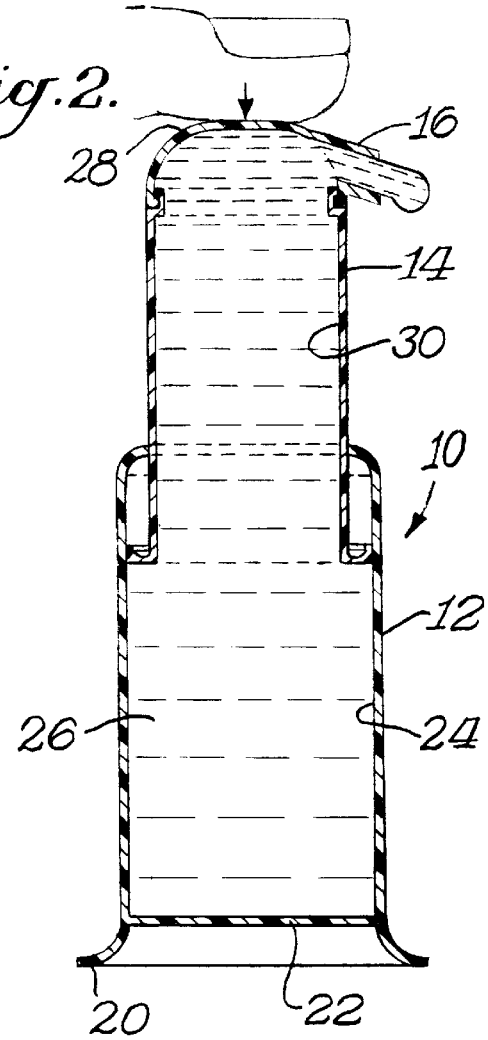
FIG. 2 is a cross-sectional view in elevation of the dispenser shown in FIG. 1 during its mode of operation.

As shown in FIG. 2 the base 20 of the barrel 24 is outwardly flared to enhance the stability of the dispenser 10 when mounted on a support surface such as a counter or sink top. The lower end of barrel 12 is closed in any suitable manner such as by a membrane 22. The upper end of barrel 12 has an inwardly turned shoulder 32 creating an opening into which the plunger 14 is mounted. Thus, a chamber 24 is created within barrel 12 for holding fluid 26, such as toothpaste or the like.

As also shown in FIG. 2 the lower end of plunger 14 is open to communicate with the chamber 24 of barrel 12 whereby the chamber 30 within plunger 14 forms a continuous variable size combined chamber, the size of which varies in accordance with the degree of telescopic insertion of plunger 14 in barrel 12. The top 28 of plunger 14 is closed except for the dispensing spout 16.

Figure 3:
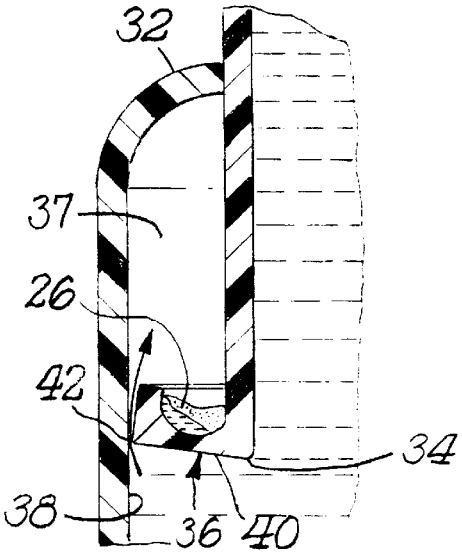
FIG. 3 is an enlarged fragmental cross-sectional view showing the sealing arrangement and collection chamber of the dispenser shown in FIG. 2.

FIG. 3 best illustrates the details of the seal between plunger 14 and barrel 12. As shown therein the lower edge 34 of plunger 14 has a peripheral piston head 36 which includes a dished out peripheral rim 40 having a corner 42 which makes sealing contact with the inner surface 38 of barrel 12. This type of seal is described in U.S. Pat. No. 5,092,496, the details of which are incorporated herein by reference thereto.

A further function of the shoulder 32 is to act as a stop for preventing the plunger 14 from being completely removed from the upper end of barrel 12. Thus, during assembly of the components the plunger would be inserted through the lower end of barrel 12 before the membrane 22 is applied. The plunger would be completely extended to maximize the size of the combined chamber. Fluid such as toothpaste would be inserted into the combined chamber and the combined chamber would be closed by adding the membrane 22 to the bottom of barrel 12.

By reversing the arrangement of the piston and barrel from the conventional arrangement to the arrangement shown in FIGS. 1–3 various leakage problems are avoided. For example, with the conventional arrangements if there is not a highly effective seal between the piston head and barrel there may be blow by or seepage at the seal. Because of gravity such seepage could flow out of the open end of the barrel. With the arrangement of this invention, however, if there is any seepage such material 26 would pass into a collection chamber 37 between the shoulder 32 and the piston head 36 thereby preventing the material 26 from escaping outside of the dispenser. Accordingly, any such leakage would not be evident to the user since the leakage would be collected and maintained within the separate chamber 37 of the dispenser. Accordingly, by having the plunger in the top of the barrel instead of sliding through the bottom of the barrel it is not as necessary to have as effective a seal. Thus, better slide characteristics could be attained with this arrangement because as tight a seal is not necessary.

What is claimed is:

1. A pump type fluid dispenser comprising an outer tubular barrel having a lower base end for resting on a support surface, said barrel being closed at said lower end for forming a fluid containing chamber within said barrel, said barrel being open at its upper end, a hollow tubular plunger slidably telescoped into said barrel through said upper end of said barrel, said plunger having an upper end and a lower end, said upper end of said plunger extending outwardly beyond said upper end of said barrel, the diameter of said plunger being greater than the radius of said barrel whereby the outer surface of said plunger is disposed close to the inner surface of said barrel, a dispensing spout at said upper end of said plunger, said upper end of said plunger being closed by a cap having an upper surface, said dispensing spout, being integral with said cap, said dispensing spout extending no higher than said upper surface of said cap whereby said upper is the most outward portion of said dispenser, a fluid containing chamber within said plunger, said lower end of said plunger being open to create flow communication between said chamber of said barrel and said chamber of said plunger to create a continuous variable size combined chamber extending from said lower end of said barrel to said upper end of said plunger, the size of said combined chamber being determined by the extent of said plunger telescoping into said barrel, the outer surface of said plunger conforming in size and shape to the opening of said upper end of said barrel to minimize any fluid passing through said opening of said upper end of said barrel in the area of sliding contact between said plunger and the inner edge of said barrel opening, and a peripheral piston head around said plunger at said lower end of said plunger in sealing sliding contact with the inner surface of said barrel to force fluid to be dispensed from said plunger dispensing opening when said plunger is pushed downwardly into said barrel to reduce the size of said combined chamber.

2. The dispenser of claim 1 including a collection chamber within said barrel and peripherally around said plunger.

3. The dispenser of claim 1 wherein said upper end of said barrel has an inturned shoulder directed toward the outer surface of said plunger, and said collection chamber being located between said inturned shoulder and said piston head.

4. The dispenser of claim 3 wherein said fluid is toothpaste.

5. The dispenser of claim 3 wherein said inturned shoulder comprises stop structure for preventing said plunger from being completely withdrawn from said upper end of said barrel.

* * * * *